US009361819B2

(12) United States Patent
Iguchi

(10) Patent No.: US 9,361,819 B2
(45) Date of Patent: Jun. 7, 2016

(54) IMAGE DISPLAY DEVICE AND METHOD OF CONTROLLING THE SAME

(71) Applicant: SEIKO EPSON CORPORATION, Tokyo (JP)

(72) Inventor: Tatsuya Iguchi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 10 days.

(21) Appl. No.: 14/330,454

(22) Filed: Jul. 14, 2014

(65) Prior Publication Data

US 2015/0022569 A1 Jan. 22, 2015

(30) Foreign Application Priority Data

Jul. 19, 2013 (JP) ..... 2013-150215

(51) Int. Cl.

| | |
|---|---|
| ***G09G 5/02*** | (2006.01) |
| ***G09G 3/00*** | (2006.01) |
| ***G09G 3/20*** | (2006.01) |
| ***G09G 3/34*** | (2006.01) |

(52) U.S. Cl.

CPC ..... *G09G 3/001* (2013.01); *G09G 3/2092* (2013.01); *G09G 3/3406* (2013.01); *G09G 2320/0271* (2013.01); *G09G 2320/041* (2013.01); *G09G 2320/062* (2013.01); *G09G 2320/066* (2013.01); *G09G 2320/0613* (2013.01); *G09G 2360/16* (2013.01); *G09G 2370/08* (2013.01)

(58) Field of Classification Search

CPC ... G09G 3/001; G09G 3/2092; G09G 3/3406; G09G 2320/0271; G09G 2370/08; G09G 2320/0613; G09G 2320/062; G09G 2320/06; G09G 2360/16; G09G 2320/041

See application file for complete search history.

(56) References Cited

U.S. PATENT DOCUMENTS

| | | | | |
|---|---|---|---|---|
| 2005/0068270 | A1* | 3/2005 | Awakura | G09G 3/3208 345/76 |
| 2007/0263179 | A1 | 11/2007 | Katsuragawa et al. | |
| 2009/0015532 | A1 | 1/2009 | Katayama et al. | |

FOREIGN PATENT DOCUMENTS

| | | |
|---|---|---|
| JP | A-2002-72361 | 3/2002 |
| JP | A-2009-20340 | 1/2009 |
| JP | A-2012-32583 | 2/2012 |
| JP | A-2012-181466 | 9/2012 |
| WO | WO 2006/137416 A1 | 12/2006 |

* cited by examiner

*Primary Examiner* — Charles Hicks
(74) *Attorney, Agent, or Firm* — Oliff PLC

(57) ABSTRACT

An image display device adapted to display an image based on an image signal includes a light source, an adjustment section adapted to adjust light intensity of a light emitted from the light source based on a feature amount related to a luminance of the image, a modulation section adapted to modulate the adjusted light based on the image signal, and a control section adapted to suppress reduction of the light intensity by the adjustment section in a case in which a predetermined condition related to temperature of the modulation section is satisfied.

18 Claims, 5 Drawing Sheets

IMAGE DISPLAY DEVICE AND METHOD OF CONTROLLING THE SAME

The entire disclosure of Japanese Patent Application No. 2013-150215, filed Jul. 19, 2013, is expressly incorporated by reference herein.

BACKGROUND

1. Technical Field

The present invention relates to an image display device and a method of controlling the image display device.

2. Related Art

As a configuration of a display device for displaying an image such as a content, there has been known a projector, which modulates a light emitted from a light source in accordance with an image signal using a light modulation device, and then projects the modulated light on a screen or the like in an enlarged manner to display the image. Such a light modulation device is formed of liquid crystal light valves or the like provided with a plurality of pixels, and controls the transmittance of the light pixel by pixel in accordance with the grayscale information represented by the image signal to thereby form the image corresponding to the image signal.

In resent years, there has been proposed a projector provided with an expansion device for correcting the grayscale (the transmittance) of each of the pixels in order to expand the effective grayscale range, and a dimming device capable of roughly evenly reducing the intensity of the light entering each of the pixels of the light modulation device in accordance with the correction as described in JP-A-2012-32583. According to this configuration, it becomes possible to increase the number of the effective grayscales (expand the dynamic range) to improve the contrast feel by performing an adaptive dimming process, namely reduction of the light intensity by the dimming device and the expansion of the grayscale range by the expansion device based on a feature amount of the image, when displaying, for example, a dark image.

Incidentally, it is known that the projector used in a cool environment has the liquid light valves or the like disposed inside also in a cool state, takes time from when the projector is started until the inside is warmed by the energy of the light emitted from the light source, and is slow in response speed of the liquid crystal in a period until the liquid crystal light valves are heated to a predetermined temperature, and has the display quality degraded. Therefore, it is desirable that the liquid crystal light valves in the cool state are rapidly warmed when the projector is started up.

However, in the case of starting up the projector in the cool environment to start the projection of the image, the adaptive dimming process is performed in accordance with the luminance of the image, and the light intensity is decreased by the dimming device if the image is dark, and therefore, it takes time to warm the liquid crystal light valves. Therefore, the period for performing the projection in the state in which the display quality is degraded is long at the time of start up compared to the case in which the light intensity is not reduced, and in some cases, uncomfortable feeling is provided to the observer.

SUMMARY

An advantage of some aspects of the invention is to control the adaptive dimming process based on the feature amount of the image in a predetermined condition such as a cool state to promptly restoring the degradation of the display quality of the projector.

The invention can be implemented as the following forms or application examples.

APPLICATION EXAMPLE 1

An image display device according to this application example is an image display device adapted to display an image based on an image signal including a light source, an adjustment section adapted to adjust light intensity of a light emitted from the light source based on a feature amount related to a luminance of the image, a modulation section adapted to modulate the adjusted light based on the image signal, and a control section adapted to suppress reduction of the light intensity by the adjustment section in a case in which a predetermined condition related to temperature of the modulation section is satisfied.

According to such a configuration, the adjustment section adjusts the light intensity of the light emitted from the light source based on the feature amount related to the luminance of the image, and the control section suppresses the reduction of the light intensity by the adjustment section in the case in which the predetermined condition related to the temperature of the modulation section is satisfied, and the modulation section modulates the adjusted light based on the image signal. Therefore, the light intensity of the light emitted from the light source is adjusted by the adjustment section based on the control of the control section, the light thus adjusted reaches the modulation section, and the modulation section is heated by the light having reached. Here, in the case in which the predetermined condition related to the temperature of the modulation section is satisfied, since the reduction of the light intensity of the light reaching the modulation section is suppressed, the temperature of the modulation section rises, and the degradation of the display quality in the modulation section can promptly be improved.

APPLICATION EXAMPLE 2

In the image display device according to the application example described above, it is preferable that the control section stops the reduction of the light intensity by the adjustment section in a case in which the predetermined condition is satisfied.

According to such a configuration, in the case in which the predetermined condition is satisfied, since the light intensity of the light reaching the modulation section is not reduced, the rise in temperature of the modulation section can be accelerated.

APPLICATION EXAMPLE 3

In the image display device according to the application example described above, it is preferable that the adjustment section adjusts the light intensity based on the feature amount and the control by the control section.

According to such a configuration, the rise in temperature of the modulation section can be controlled based on the feature amount related to the luminance of the image.

APPLICATION EXAMPLE 4

In the image display device according to the application example described above, it is preferable that the adjustment section determines a reduction coefficient used to reduce the light intensity based on the feature amount, determines a suppression coefficient used to suppress the reduction corresponding to the reduction coefficient based on the control by the control section, and reduces the light intensity based on the reduction coefficient and the suppression coefficient.

According to such a configuration, the adjustment section reduces the light intensity based on the reduction coefficient determined based on the feature amount and the suppression coefficient used to suppress the reduction corresponding to the reduction coefficient. Therefore, since the light intensity is controlled based on the two coefficients, the rise in temperature of the modulation section can accurately be controlled.

APPLICATION EXAMPLE 5

In the image display device according to the application example described above, it is preferable that the control section instructs remove of the suppression in a case in which the predetermined condition having been satisfied changed to be unsatisfied, and the adjustment section reduces the light intensity based on the reduction coefficient.

According to such a configuration, in the case in which the predetermined condition having been satisfied becomes unsatisfied, improvement in contrast of the image to be modulated by the modulation section can be achieved by reducing the light intensity based on the reduction coefficient related to the feature amount.

APPLICATION EXAMPLE 6

In the image display device according to the application example described above, it is preferable that there is further included an expansion section adapted to expand a grayscale range of the luminance of an image represented by the image signal based on the feature amount, and the expansion section expands the grayscale range so that the luminance of a modulated image obtained by modulating the image signal in the modulation section becomes roughly constant irrespective of whether or not the predetermined condition is satisfied.

According to such a configuration, since the luminance of the modulated image becomes roughly constant irrespective of the predetermined condition, the uncomfortable feeling caused by the variation in luminance of the image due to the suppression of the reduction can be avoided.

APPLICATION EXAMPLE 7

In the image display device according to the application example described above, it is preferable that there is further included a temperature information acquisition section adapted to obtain information related to the temperature of the modulation section, and the control section suppresses the reduction of the light intensity by the adjustment section in a case in which the temperature is one of equal to and lower than a predetermined temperature.

According to such a configuration, by obtaining the temperature of the modulation section, the reduction of the light intensity can be suppressed in accordance with the temperature of the modulation section.

APPLICATION EXAMPLE 8

In the image display device according to the application example described above, it is also possible that the control section suppresses the reduction of the light intensity by the adjustment section in a case in which a predetermined reference time does not elapse from when the light source is put on.

APPLICATION EXAMPLE 9

In the image display device according to the application example described above, it is preferable that there is further included an image processing section adapted to generate the feature amount and the image signal based on image data input.

According to such a configuration, the feature amount and the image signal can be generated based on the image data input.

APPLICATION EXAMPLE 10

A control method according to this application example is a method of controlling an image display device adapted to display an image based on an image signal, the method including: adjusting light intensity of a light emitted from a light source based on a feature amount related to a luminance of the image, modulating, by a modulation section, the adjusted light based on the image signal, and suppressing reduction of the light intensity in adjusting in a case in which a predetermined condition related to temperature of the modulation section is satisfied.

According to such a method, the light intensity of the light emitted from the light source is adjusted in the adjusting based on the feature amount related to the luminance of the image, and the reduction of the light intensity in adjusting is suppressed in suppressing in the case in which the predetermined condition related to the temperature of the modulation section is satisfied, and the adjusted light is modulated in modulating based on the image signal. Therefore, the light intensity of the light emitted from the light source is adjusted in adjusting based on the control in suppressing, the light thus adjusted reaches the modulation section, and the modulation section is heated by the light having reached. Here, in the case in which the predetermined condition related to the temperature of the modulation section is satisfied, since the reduction of the light intensity of the light reaching the modulation section is suppressed, the temperature of the modulation section rises, and the degradation of the display quality in the modulation section can promptly be improved.

BRIEF DESCRIPTION OF THE DRAWINGS

The invention will be described with reference to the accompanying drawings, wherein like numbers reference like elements.

DESCRIPTION OF AN EXEMPLARY EMBODIMENT

An embodiment of the invention will hereinafter be explained with reference to the accompanying drawings.

Embodiment

Hereinafter, the projector for modulating the light emitted from the light source in accordance with the image signal to display the image by projecting the modulated light on a screen or the like in an enlarged manner will be explained as an image display device according to the embodiment of the invention.

Figure 1:
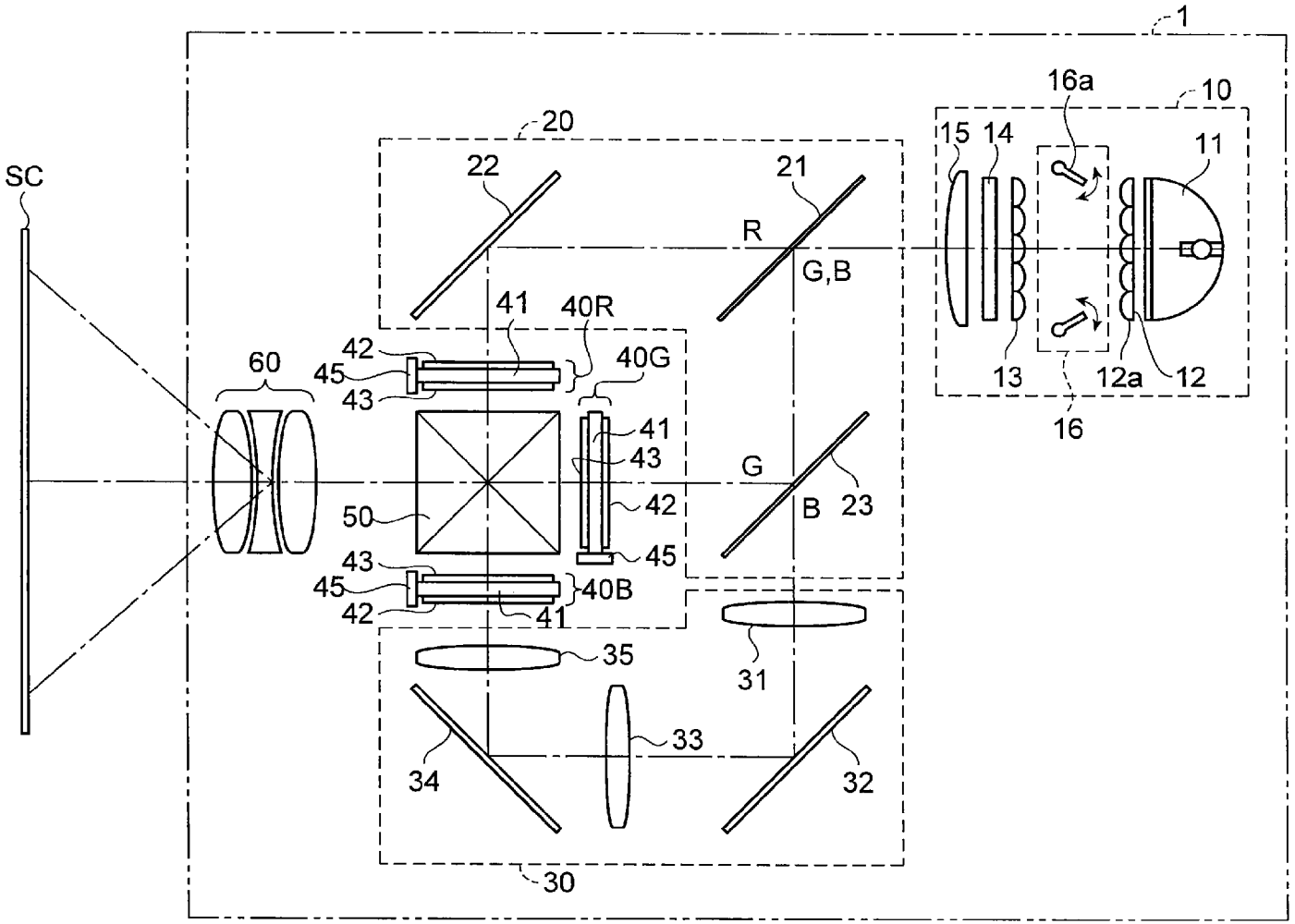
FIG. 1 is a configuration diagram showing a schematic configuration of a projector according to an embodiment of the invention.

FIG. 1 is a configuration diagram showing a schematic configuration of the projector 1, and shows a light path along which the light emitted from the light source 11 reaches the screen SC. As shown in FIG. 1, the projector 1 is provided with an illumination optical system 10, a color separation optical system 20, a relay optical system 30, three liquid crystal light valves 40R, 40G, and 40B as a light modulation device, a cross dichroic prism 50 as a combining optical system, and a projection lens 60 as a projection optical system.

The illumination optical system 10 is provided with a light source 11 formed of a discharge light source lamp such as a super high pressure mercury lamp or a metal halide lamp, a first lens array 12, a second lens array 13, a polarization conversion element 14, an overlapping lens 15, and a dimming element 16. The light emitted from the light source 11 is divided into a number of minute lights by the first lens array 12 composed of minute lenses 12*a* arranged in a matrix. The second lens array 13 and the overlapping lens 15 are provided so that each of the lights obtained by the dividing operation illuminates the entire three liquid crystal light valves 40R, 40G, and 40B as the illumination object. Therefore, the lights are overlapped each other on the liquid crystal light valves 40R, 40G, and 40B, and the entire liquid crystal light valves 40R, 40G, and 40B are roughly evenly illuminated. It should be noted that in the present embodiment, the liquid crystal light valves 40R, 40G, and 40B correspond to a modulation section.

Here, the light path between the first and second lens arrays 12, 13 is provided with the dimming element 16. The dimming element 16 is arranged to be able to narrow down the light emitted from the first lens array 12 due to the rotation of a louver 16*a*, and can block some of the lights divided into by the first lens array 12. Therefore, the intensity of the light illuminating the liquid crystal light valves 40R, 40G, and 40B is roughly evenly limited in accordance with the amount of narrowing down of the dimming element 16.

It should be noted that the dimming element 16 is not limited to the type of dimming using the rotation of the louver 16*a*. For example, a second liquid crystal panel lower in resolution than the resolution of the liquid crystal light valves 40R, 40G, and 40B can be installed at the position of the louver 16*a* or on the entrance side of each of the liquid crystal light valves 40R, 40G, and 40B instead of the louver 16*a*. In this case, the light intensity of the light transmitted through the second liquid crystal panel can be suppressed by blocking the light with the pixels of the second liquid crystal panel.

The polarization conversion element 14 has a function of uniformizing the light from the light source 11 into polarized light having a specific polarization direction in order to make it possible to efficiently use the light from the light source 11 in the liquid crystal light valves 40R, 40G, and 40B. The polarized light emitted from the illumination optical system 10 enters the color separation optical system 20.

The color separation optical system 20 is provided with a first dichroic mirror 21, a first reflecting mirror 22, and a second dichroic mirror 23, and divides the light emitted from the illumination optical system 10 into three colors of light different in wavelength band from each other. The first dichroic mirror 21 transmits roughly red light, and reflects light having a wavelength shorter than the wavelength of the light to be transmitted. The red light R transmitted through the first dichroic mirror 21 is reflected by the first reflecting mirror 22 to illuminate the liquid crystal light valve 40R for the red light.

Among the light reflected by the first dichroic mirror 21, the green light G is reflected by the second dichroic mirror 23 to illuminate the liquid crystal light valve 40G for the green light. Further, the blue light B is transmitted through the second dichroic mirror 23, passes through the relay optical system 30 to illuminate the liquid crystal light valve 40B for the blue light.

It should be noted that since the path of the blue light B becomes longer than the paths of other colored lights, in order to inhibit the efficiency of the illumination of the liquid crystal light valve 40B from deteriorating due to the diffusion of the light, the relay optical system 30 is disposed in the path of the blue light B. The relay optical system 30 is provided with an entrance side lens 31, a second reflecting mirror 32, a relay lens 33, a third reflecting mirror 34, and an exit side lens 35. The blue light B emitted from the color separation optical system 20 is converged by the entrance side lens 31 in the vicinity of the relay lens 33, and is diffused toward the exit side lens 35.

The liquid crystal light valves 40R, 40G, and 40B are each provided with a liquid crystal panel 41 having a liquid crystal material encapsulated between a pair of transparent substrates. In the inside of the liquid crystal panel 41, transparent electrodes (pixel electrodes) capable of applying the drive voltage to the liquid crystal in each of minute areas (pixels) are formed in a matrix. On the entrance side and the exit side of the liquid crystal panel 41, there are installed an entrance side polarization plate 42 and an exit side polarization plate 43, respectively. Each of the entrance side polarization plate 42 and the exit side polarization plate 43 can transmit only the polarized light with a specific polarization direction, and the entrance side polarization plate 42 is arranged to be able to transmit the polarized light with the polarization direction uniformized by the polarization conversion element 14. Therefore, large proportions of the colored lights respectively entering the liquid crystal light valves 40R, 40G, and 40B enter the liquid crystal panels 41 through the entrance side polarization plates 42. It should be noted that the liquid crystal light valves 40R, 40G, and 40B are each provided with a drive circuit (not shown) for driving the liquid crystal panel 41 based on the image signal to be input.

Further, a temperature sensor 45 is installed in the side end portion of the liquid crystal panel 41 of each of the liquid crystal light valves 40R, 40G, and 40B. The temperature sensor 45 may be a semiconductor sensor, for example. The temperature sensor 45 is provided with a function of converting the temperature information of the liquid crystal panel 41 into an electric signal and then outputting the electric signal. In the case in which the illumination optical system 10 is started up and the light enters the liquid crystal panel 41, the temperature sensor 45 detects the rise in temperature of the liquid crystal panel 41 due to the conversion of the light energy of the light having entered the liquid crystal panel 41 into the thermal energy. It should be noted that the temperature sensor 45 corresponds to a temperature information acquisition section.

It should be noted that although the temperature sensor 45 is installed in the liquid crystal panel 41 of each of the liquid crystal light valves 40R, 40G, and 40B in the present embodiment, the temperature sensor 45 can be installed in at least one of the liquid crystal panels 41 of the liquid crystal light valves 40R, 40G, and 40B, or a single temperature sensor 45 can be installed in the vicinity of the color separation optical system 20. Further, the temperature sensor 45 can be installed in the periphery of the exhaust port of a cooling device (not shown) for cooling the color separation optical system 20.

Here, if the drive voltage corresponding to the image signal is applied to each of the pixels of the liquid crystal panel 41, the light entering the liquid crystal panel 41 is modulated in accordance with the drive voltage, and becomes the polarized light different in polarization direction between the pixels. In the polarized light, only the polarized component capable of passing through the exit side polarization plate 43 is emitted from each of the liquid crystal light valves 40R, 40G, and 40B. In other words, the liquid crystal light valves 40R, 40G, and 40B each transmit the incident light with the transmittance different by pixel in accordance with the image signal to thereby form the image light having gradation for each of the colored lights. The image light formed of the colored lights emitted from the liquid crystal light valves 40R, 40G, and 40B enters the cross dichroic prism 50.

The cross dichroic prism 50 combines the image lights of the respective colors emitted from the liquid crystal light valves 40R, 40G, and 40B pixel by pixel to form the image light representing the color image. The image light combined by the cross dichroic prism 50 is projected on the screen SC by the projection lens 60 in an enlarged manner, and is displayed as the image.

It should be noted that in the following explanation, the three liquid crystal light valves 40R, 40G, and 40B are collectively referred to as liquid crystal light valves 40.

Figure 2:
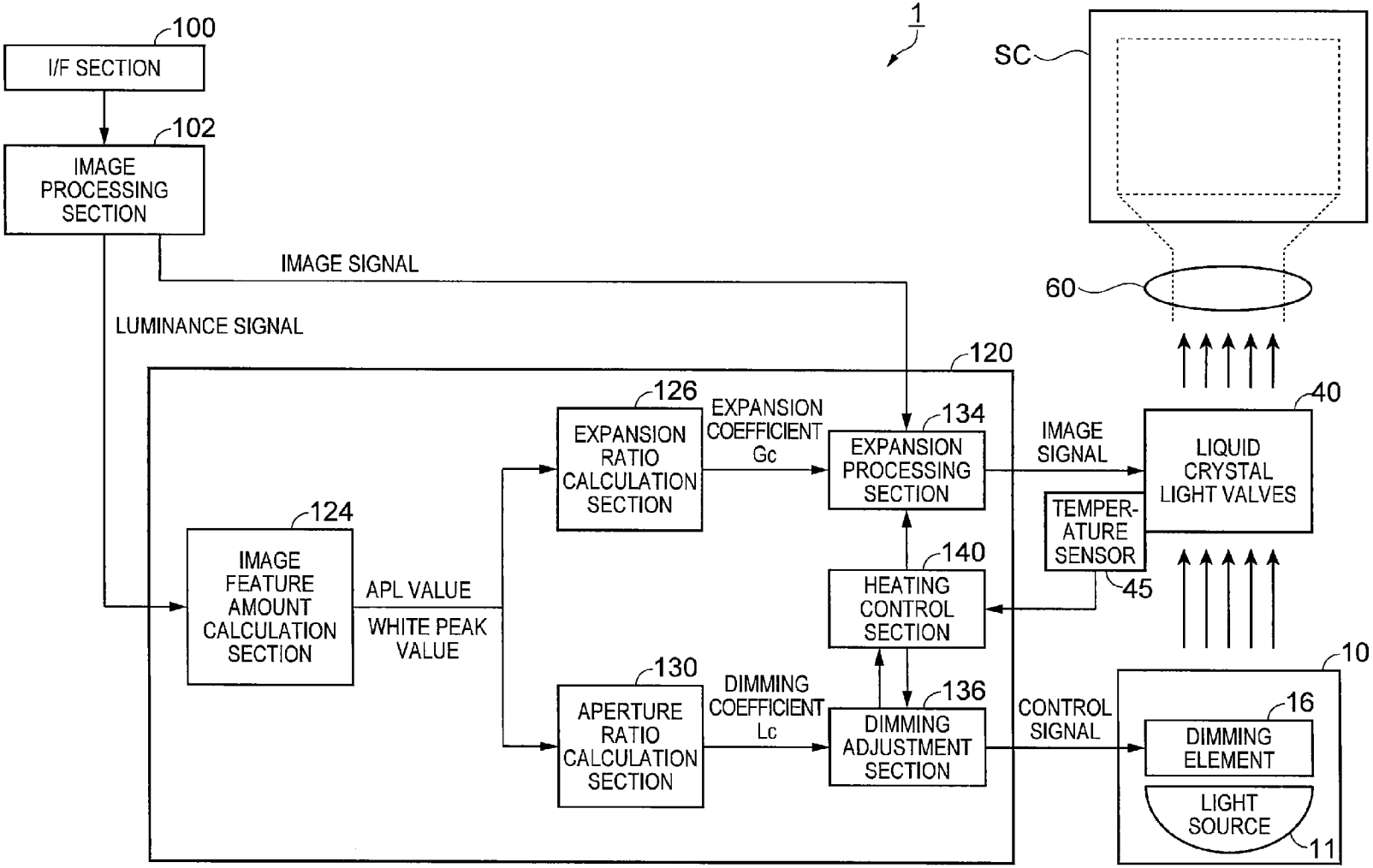
FIG. 2 is a block diagram showing a functional configuration of the projector according to the embodiment of the invention.

FIG. 2 is a block diagram showing a functional configuration of the projector 1. The projector 1 is provided with an I/F section 100, an image processing section 102, and a dimming section 120.

The dimming section 120 has a function of performing the expansion process of the luminance and the dimming control based on the luminance information of the image signal in order to expand the dynamic range and enhance the contrast feel. The dimming section 120 is provided with an image feature amount calculation section 124, an expansion ratio calculation section 126, an aperture ratio calculation section 130, an expansion processing section 134, a dimming adjustment section 136, and a heating control section 140.

It should be noted that the projector 1 has hardware such as a CPU, a ROM, a RAM, a flash memory, and so on all not shown, and the functions of the functional sections described above is realized by the hardware and software stored in the ROM and so on in cooperation with each other.

The I/F section 100 receives a variety of types of content images as an input image input from the outside such as a DVD reproduction device or the Internet, converts the image data of the content images thus received into a predetermined internal format, and then outputs the image data having been converted into the predetermined internal format to the image processing section 102.

The image processing section 102 performs a resizing process based on the image data of the content image input from the I/F section 100, and at the same time, generates the image signal expressing each of the grayscales of R (red), G (green), and B (blue) with a 10-bit luminance value (0 through 1023), and a luminance signal Y. It should be noted that the luminance signal Y is formed of a 10-bit luminance value representing the luminance when combining the colors, and can be calculated as the following formula based on each of the image signals: $Y=0.299R+0.578G+0.144B$ (R, G, and B are the luminance value of the respective colors). Alternatively, it is possible to use the maximum value of R, G, and B as the luminance signal Y. The image signal is transmitted to the dimming section 120 frame by frame via a buffer memory not shown. Further, the luminance signal Y is transmitted to the image feature amount calculation section 124.

Then, the functional sections of the dimming section 120 will be explained.

The image feature amount calculation section 124 calculates an APL value and a white peak value WP based on the luminance signal Y calculated by the image processing section 102.

In the present embodiment, the image feature amount calculation section 124 divides the image frame into small regions with a predetermined size (e.g., 16×16 pixels). Subsequently, the image feature amount calculation section 124 calculates an average value of the luminance of the pixels in each of the small regions, averages the average values of the luminance of the small regions thus calculated to obtain the APL value, and then sets the maximum value of the luminance of the small regions to the white peak value WP. Here, the APL value and the white peak value WP are each expressed in 10 bits. The information of the APL value and the white peak value WP calculated by the image feature amount calculation section 124 are transmitted to the expansion ratio calculation section 126 and the aperture ratio calculation section 130.

The expansion ratio calculation section 126 calculates an expansion coefficient Gc representing the expansion ratio with reference to an expansion coefficient look-up table (LUT) described later using the APL value and the white peak value WP calculated by the image feature amount calculation section 124. It should be noted that the range of the value of the expansion coefficient Gc can arbitrarily be set, and is set to a range of, for example, 0 through 255.

Figure 3:
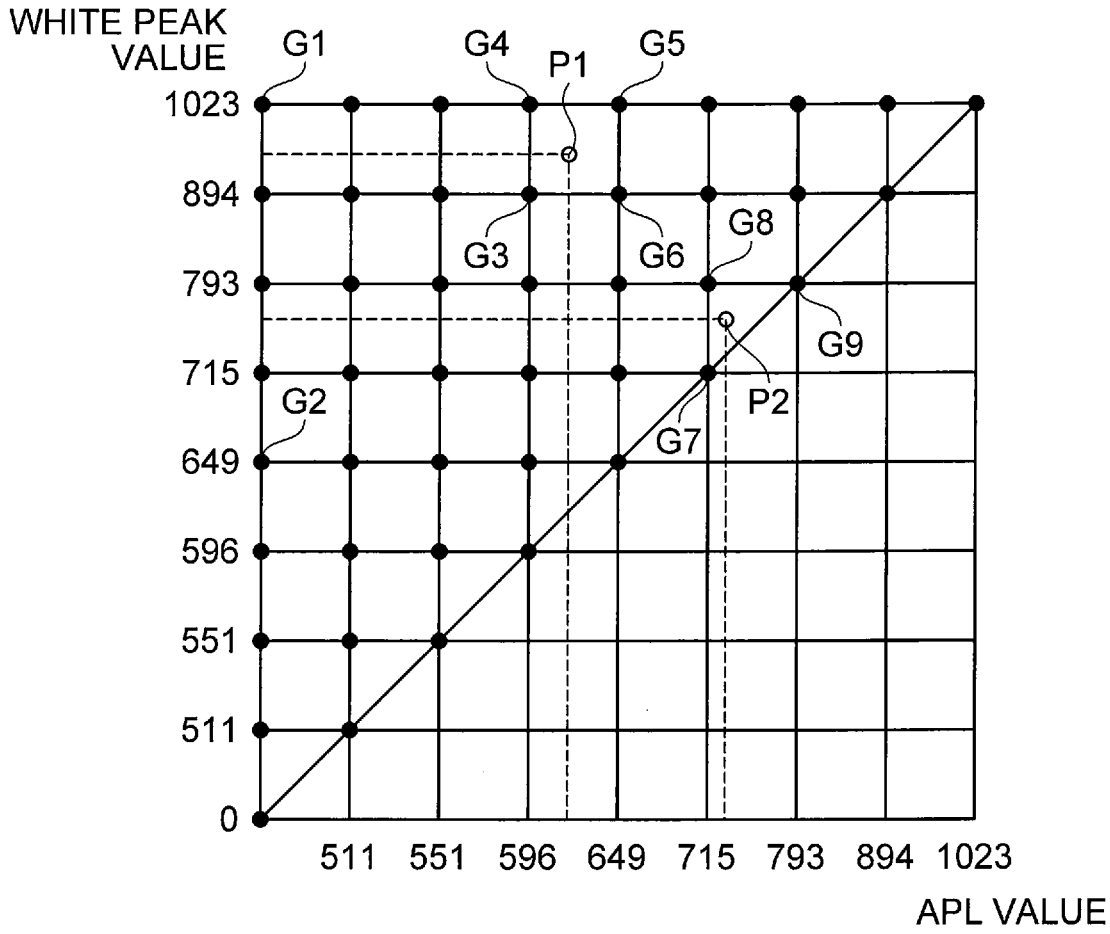
FIG. 3 is an explanatory diagram showing an example of input grid points of an expansion coefficient.

FIG. 3 is an explanatory diagram showing an example of input grid points of the expansion coefficient LUT. In FIG. 3, the horizontal axis represents the APL value, and the vertical axis represents the white peak value WP. The expansion coefficient Gc is stored in each of the input grid points indicated by filled circles shown in FIG. 3. Since the APL value never exceeds the white peak value WP, no expansion coefficient Gc is stored in the input grid points in the lower right half of the expansion coefficient LUT, and thus the reduction of the memory amount is achieved.

In the case in which a set of the APL value and the white peak value WP corresponds to any one of the input grid points (the filled circles) in FIG. 3, the expansion ratio calculation section 126 reads out and uses the expansion coefficient Gc at that input grid point without modification. In the case in which the set of the APL value and the white peak value WP does not correspond to the input grid points, for example, the case of the coordinate P1 or the coordinate P2, the expansion coefficient Gc is obtained by an interpolation calculation. For example, in the case of the coordinate P1 surrounded by the four input grid points, the expansion coefficient Gc can be calculated by appropriately performing a four-point interpolation calculation from the surrounding four input grid points G3 through G6. Further, in the case of the coordinate P2 surrounded by the three input grid points, the expansion coefficient Gc can be calculated by appropriately performing a three-point interpolation calculation from the surrounding three input grid points G7 through G9. The expansion coefficient Gc calculated by the expansion ratio calculation section 126 is transmitted to the expansion processing section 134.

Meanwhile, the aperture ratio calculation section 130 derives the dimming coefficient Lc representing the aperture ratio with reference to a dimming control look-up table using the APL value and the white peak value WP as the feature amounts calculated by the image feature amount calculation section 124. It should be noted that the range of the value of the dimming coefficient Lc can arbitrarily be set, and is set to a range of, for example, 0 through 255.

It should be noted that in the present embodiment, the dimming coefficient LUT has the same configuration as that of the expansion coefficient LUT. Further, the method of determining the dimming coefficient Lc with reference to the dimming coefficient LUT is the same as the method of determining the expansion coefficient Gc, and therefore the detailed explanation thereof will be omitted.

The heating control section 140 obtains an electrical signal from the temperature sensor 45 installed in the end portion of each of the liquid crystal light valves 40 at predetermined time intervals, and then calculates the temperature information of the liquid crystal light valves 40 from the electrical signals thus obtained. Then, the heating control section 140 makes a determination on a predetermined condition related to the temperature information thus calculated, and then transmits a control signal to the dimming adjustment section 136 based on the determination result. It should be noted that in the present embodiment, the heating control section 140 corresponds to a control section.

In the present embodiment, the fact that the temperature of the liquid crystal light valves 40 is equal to or lower than a reference temperature is used as the predetermined condition. Therefore, in the case in which the predetermined condition is satisfied, namely in the case in which it is determined that the temperature of the liquid crystal light valves 40 is equal to or lower than the reference temperature, the heating control section 140 performs the control of reducing the aperture using the louver 16*a* of the dimming element 16. In the present embodiment, the heating control section 140 generates the control signal for performing the control (aperture amount correction control) of increasing the light intensity reaching the liquid crystal light valves 40 compared to normal aperture control described later, and then transmits the control signal thus generated to the dimming adjustment section 136.

Further, in the case in which the predetermined condition is not satisfied, namely in the case in which it is determined that the temperature of the liquid crystal light valves 40 exceeds the reference temperature, the heating control section 140 generates the control signal for performing the normal control (the normal aperture control) of the louver 16*a* without performing the aperture amount correction of the dimming element 16, and then transmits the control signal thus generated to the dimming adjustment section 136.

It should be noted that the reference temperature is assumed to be about 80° C. at which the response speed of the liquid crystal light valves 40 drops due to the low temperature, but is not limited to this temperature.

Further, the heating control section 140 notifies the expansion processing section 134 of control mode information representing whether the aperture amount correction control is performed on the louver 16*a* or the normal aperture control is performed on the louver 16*a*. In the present embodiment, a data flag corresponding to the control mode information can be set in a predetermined memory area.

Further, in the case in which the aperture amount correction control is performed on the louver 16*a*, the heating control section 140 obtains aperture amount correction information related to the aperture amount corrected by the aperture amount correction control from the dimming adjustment section 136, and then transmits the information thus obtained to the expansion processing section 134.

It should be noted that although the heating control section 140 controls the dimming adjustment section 136 based on the temperature information in the present embodiment, the temperature information is not a limitation. Specifically, the dimming adjustment section 136 can be controlled based on the condition related to elapsed time from when the projector 1 is started up and the light source 11 is put on. In other words, it is also possible to arrange that the aperture amount correction control is performed until a predetermined reference time elapses from when the light source 11 is put on since it is assumed that the temperature of the liquid crystal light valves 40 does not sufficiently rise, and then the normal aperture control is performed after the reference time elapses. Further, the dimming adjustment section 136 can be controlled based on the condition related to the luminance of the projection image and/or the luminance of the modulated image of the liquid crystal light valves 40, and the luminance of each image can be detected by an imaging element. Further, the dimming adjustment section 136 can be controlled in accordance with a content mode previously set by the user such as an action mode with a heady action, or a content mode obtained by analyzing the motion and so on in the image of the content projected.

The dimming adjustment section 136 firstly calculates a light intensity ratio A1 expressed by Formula 1 below from the dimming coefficient Lc. The light intensity ratio A1 represents the ratio to the maximum light intensity, and fulfills A1≤1.

$$A1=Lc/255 \tag{1}$$

Incidentally, if the light intensity ratio A1 and an expansion ratio K1 obtained by Formula 3d described below satisfy the relationship of Formula 2 below, the maximum luminance of the image, on which a luminance range expansion process and the dimming control have been performed, becomes the same as the maximum luminance of the image, on which the luminance range expansion process and the dimming control have not been performed. Here, γ denotes the γ value of the liquid crystal light values 40, and fulfills, for example, γ=2.2.

$$A1=K1^{-\gamma} \tag{2}$$

Subsequently, the dimming adjustment section 136 adjusts the drive amount of the dimming element 16 based on the value of the light intensity ratio A1 thus calculated and the control signal transmitted from the heating control section 140.

For example, in the case in which the control signal instructing the execution of the normal aperture control is transmitted from the heating control section 140, the dimming adjustment section 136 performs the normal aperture control on the dimming element 16 to perform the control of the aperture amount of the louver 16*a* on the dimming element 16 so as to achieve the light intensity ratio A1 (a reduction coefficient).

Further, in the case in which the control signal instructing the execution of the aperture amount correction control is transmitted from the heating control section 140, the dimming adjustment section 136 determines a suppression coefficient corresponding to the control signal. Here, (suppression coefficient)>1 is assumed. The dimming adjustment section 136 controls the aperture of the louver 16*a* so that the integration result of the reduction coefficient and the suppression coefficient becomes the reduction ratio of the light intensity. It should be noted that the maximum value of the reduction ratio of the light intensity is 1. On this occasion, since the reduction ratio of the light intensity is greater than the reduction coefficient, the aperture of the louver 16*a* is released compared to the case of the normal aperture control. As a result, the intensity of the light reaching the liquid crystal light valves 40 increases, and the temperature of the liquid crystal light valves 40 rises rapidly compared to the case of the normal aperture control.

It should be noted that in the case of performing the aperture amount correction control, the dimming adjustment section 136 may stops the reduction of the light intensity by the louver 16*a*, for example, a configuration of entirely releasing the aperture of the louver 16*a*.

Further, in the case of performing the aperture amount correction control, the dimming adjustment section 136 transmits the aperture correction information, which is related to the aperture amount of the louver 16*a* determined only by the value of the light intensity ratio A1, and the aperture amount of the louver 16*a* determined by the value of the light intensity ratio A1 and the control signal, to the heating control section 140. It should be noted that in the present embodiment, the dimming adjustment section 136 corresponds to an adjustment section.

The expansion processing section 134 expands the gray-scale range of the luminance, namely the distribution range of the luminance, of the image signal based on the expansion coefficient Gc calculated by the expansion ratio calculation section 126. It should be noted that in the present embodiment, the expansion processing section 134 corresponds to an expansion section.

The process by the expansion processing section 134 is performed using Formulas 3a through 3d below. Here, R0, G0, and B0 are values of color information of the image signal before performing the luminance range expansion process, and R1, G1, and B1 are values of the color information of the image signal after performing the luminance range expansion process. Further, the expansion ratio K1 is obtained by Formula 3d. It should be noted that since the expansion coefficient Gc is equal to or greater than 0, the expansion ratio K1 is equal to or greater than 1.

$$R1=K1*R0 \tag{3a}$$

$$G1=K1*G0 \tag{3b}$$

$$B1=K1*B0 \tag{3c}$$

$$K1=1+Gc/255 \tag{3d}$$

Further, the expansion processing section 134 performs a variation correction of the luminance on the image signal, on which the expansion process has been performed, based on control mode information and the aperture correction information transmitted from the heating control section 140.

It should be noted that in the case of the normal aperture control, assuming that the transmittance of the liquid crystal light valves 40 is α, the aperture amount (the transmittance) of the louver 16*a* is t1, and the intensity of the incident light to the dimming element 16 is I, the intensity V1 of the outgoing light from the liquid crystal light valves 40 can be expressed by Formula 4.

$$V1=(\alpha*t1*I) \tag{4}$$

Further, in the case of the aperture amount correction control, assuming that the transmittance of the liquid crystal light valves 40 is β, the aperture amount (the transmittance) of the louver 16*a* is t2, and the intensity of the incident light to the dimming element 16 is I, the intensity V2 of the outgoing light from the liquid crystal light valves 40 can be expressed by Formula 5.

$$V2=(\beta*t2*I) \tag{5}$$

Therefore, by performing the control so that the intensities of the two outgoing lights become equal to each other (V1=V2), it is possible to make the luminance of the projection image when performing the normal aperture control and the luminance of the projection image when performing the aperture amount correction control equal to each other. In the present embodiment, Formula 6 is obtained from Formulas 4 and 5.

$$\beta=\alpha*t1/t2 \tag{6}$$

Therefore, in the case in which the control mode information represents the execution of the aperture amount correction control, the expansion processing section 134 corrects the image signal, on which the expansion process has been performed, so that the transmittance of the liquid crystal light valves 40 satisfies Formula 6, and then transmits the image signal thus corrected to the liquid crystal light valves 40.

On the other hand, in the case in which the control mode information represents the execution of the normal aperture control, the image signal on which the expansion process has been performed is transmitted to the liquid crystal light valves 40.

As a result, in the case of the aperture amount correction control, increase in luminance due to the aperture amount adjustment of the louver 16*a* is suppressed, and thus, the image is projected with roughly the same luminance as in the case in which the normal aperture control is performed.

Figure 4:
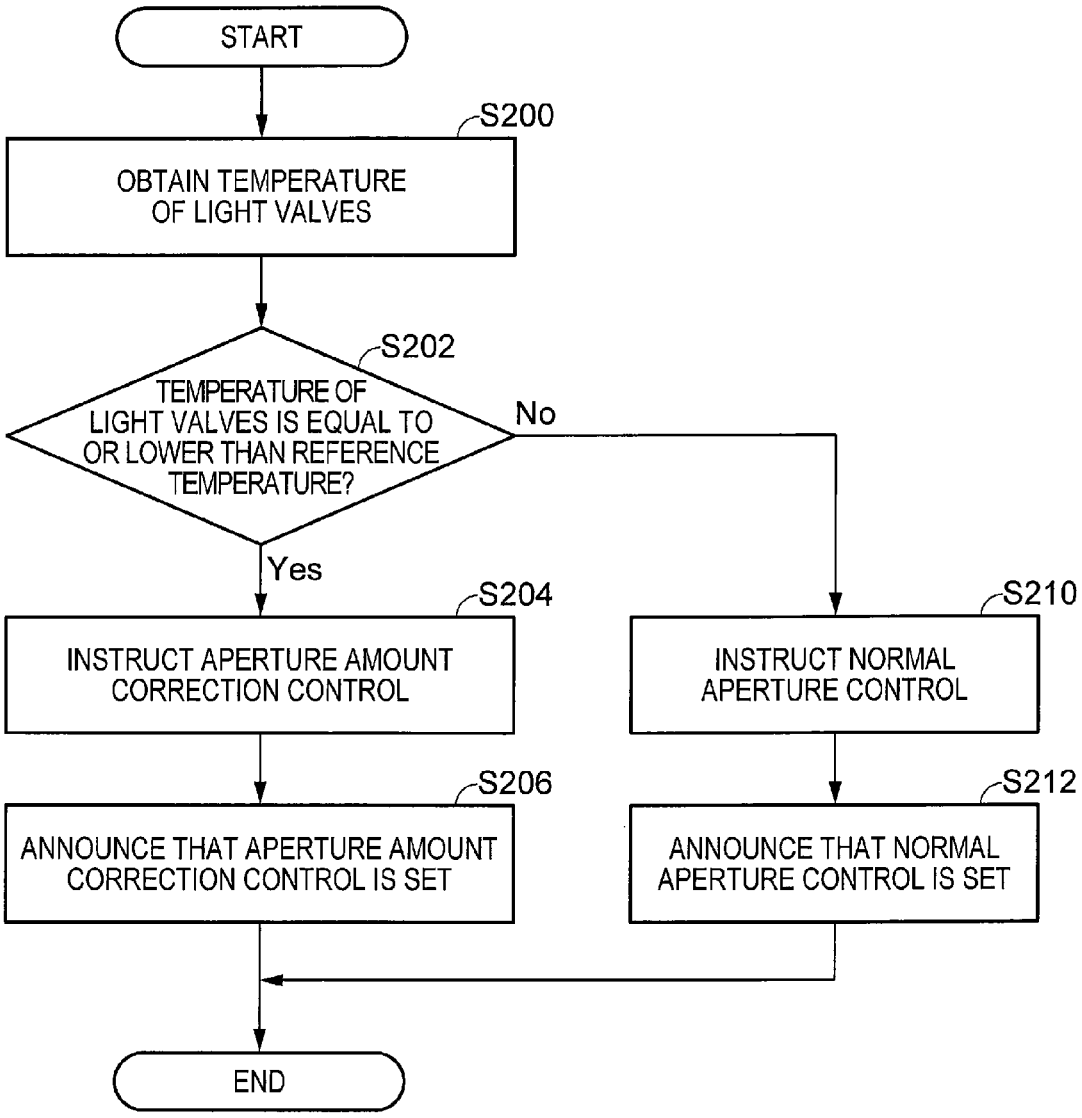
FIG. 4 is a flowchart showing a flow of a process of a heating control section instructing aperture control.

FIG. 4 is a flowchart showing a flow of the process of the heating control section 140 instructing the aperture control. This process can be stored in the ROM or the like as, for example, an aperture control program, developed in the RAM or the like by the CPU, and executed at a predetermined timing using polling.

Firstly, the heating control section 140 obtains (step S200) the temperature of the liquid crystal light valves 40 from the temperature sensor 45.

Subsequently, the heating control section 140 determines (step S202) whether or not the temperature of the liquid crystal light valves 40 is equal to or lower than the reference temperature.

Here, in the case in which it is determined that the temperature of the liquid crystal light valves 40 is equal to or lower than the reference temperature (Yes in the step S202), the heating control section 140 instructs (step S204) the execution of the aperture amount correction control to the dimming adjustment section 136. As a result, the dimming adjustment section 136 adjusts the control of the dimming element 16 based on the aperture amount correction control.

Subsequently, the heating control section 140 notifies (step S206) the expansion processing section 134 of the control mode information representing the fact that the aperture amount correction control is performed, and then terminates the present process.

On the other hand, in the case in which it is determined that the temperature of the liquid crystal light valves 40 exceeds the reference temperature (No in the step S202), the heating control section 140 instructs (step S210) the execution of the normal aperture control to the dimming adjustment section 136. As a result, the dimming adjustment section 136 adjusts the control of the dimming element 16 based on the normal aperture control.

Subsequently, the heating control section 140 notifies (step S212) the expansion processing section 134 of the control mode information representing the fact that the normal aperture control is performed, and then terminates the present process.

Figure 5:
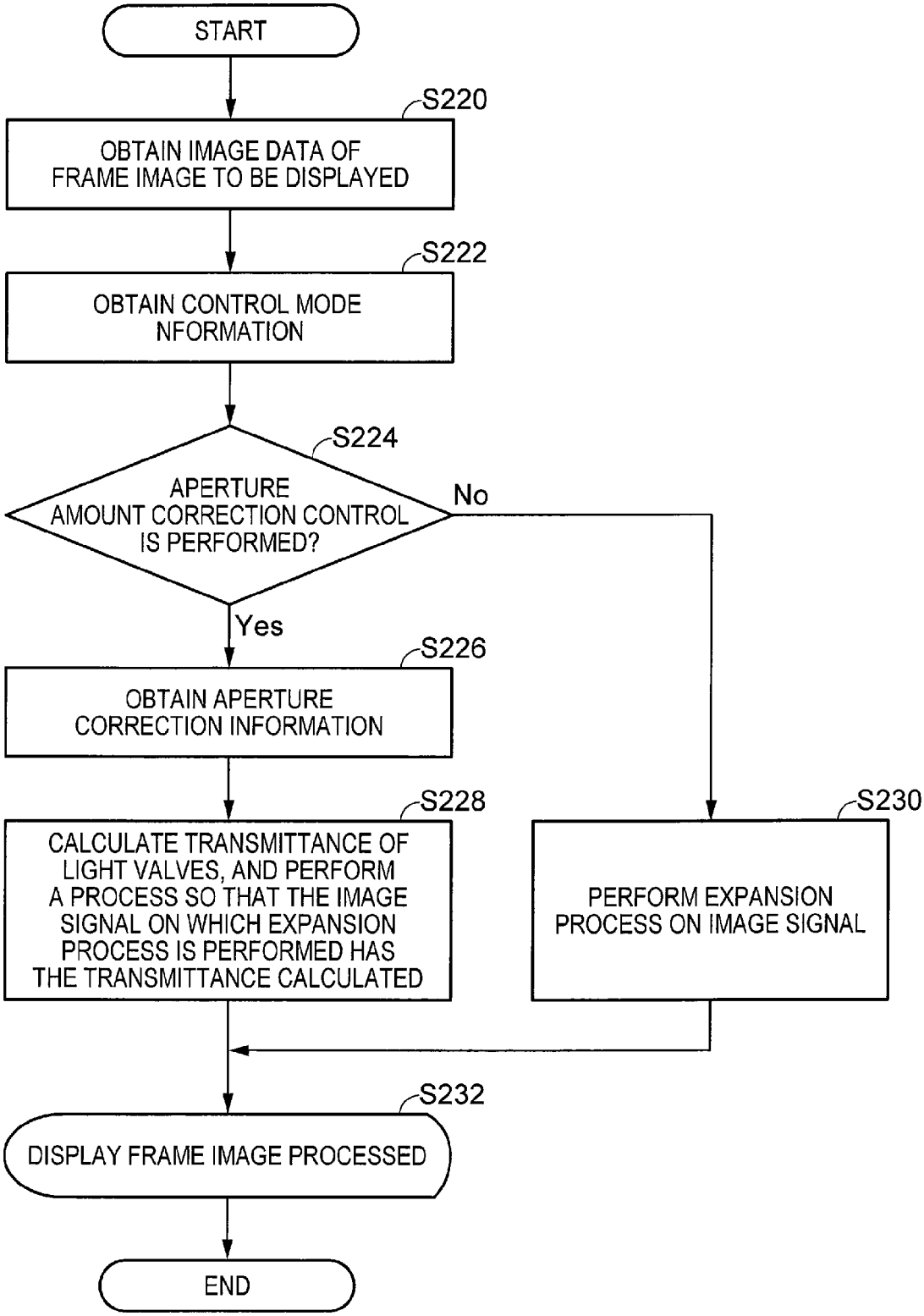
FIG. 5 is a flowchart showing a flow of a process of an expansion control section performing an expansion process corresponding to the aperture control.

FIG. 5 is a flowchart showing a flow of the process of the expansion control section 134 performing the expansion process corresponding to the aperture control. This process can be stored in the ROM or the like as, for example, an aperture control program, developed in the RAM or the like by the CPU, and executed for each frame image.

Firstly, the expansion processing section 134 obtains (step S220) the image data of the frame image to be displayed.

Subsequently, the expansion processing section 134 obtains (step S222) the control mode information announced by the heating control section 140, and then determines (step S224) whether or not the aperture amount correction control is performed based on the control mode information.

Here, in the case in which it is determined that the aperture amount correction control is performed (Yes in the step S224), the expansion processing section 134 obtains (step S226) the aperture correction information from the heating control section 140.

Subsequently, the expansion processing section 134 calculates the transmittance of the liquid crystal light valves 40 based on the aperture correction information, then processes (step S228) the image signal so that the image signal, on which the expansion process has been performed based on the expansion coefficient Gc, has the transmittance thus calculated, and then the process proceeds to the step S232.

On the other hand, in the case in which it is determined that the aperture amount correction control is not performed, namely in the case in which the normal aperture control is performed (No in the step S224), the expansion processing section 134 performs (step S230) the expansion process based on the expansion coefficient Gc on the image signal, and then the process proceeds to the step S232.

In the step S232, the expansion processing section 134 transmits the control signal based on the image signal thus processed to the liquid crystal light valves 40, then displays the frame image, and then terminates the process.

According to the embodiment described hereinabove, the following advantages can be obtained.

1. In the case in which the projector 1 provided with the adaptive dimming processing function of expanding the dynamic range to enhance the contrast feel is started up, the projector 1 obtains the temperature of the liquid crystal light valves 40, and if the temperature thus obtained is equal to or lower than the reference temperature, the projector 1 suppress the dimming adjustment for reducing the light intensity of the light emitted from the light source 11 to heat the liquid crystal light valves 40 with the light energy of the light to thereby achieve the rise in temperature of the liquid crystal light valves 40. Therefore, it can promptly be avoided that the display quality is degraded due to the delay caused by the response speed of the liquid crystal in the case in which the start up is performed in the cool environment.

2. Since the suppression to the dimming adjustment is removed in the case in which the temperature exceeds the reference temperature due to the heating of the liquid crystal light valves 40, the contrast feel of the image to be projected can be enhanced.

3. Since the expansion process is performed so that the luminance of the image to be projected does not vary irrespective of the presence or absence of the suppression to the dimming adjustment, the uncomfortable feeling due to the variation in the luminance of the image to be projected can be eliminated.

Although the embodiment of the invention is described hereinabove with reference to the accompanying drawings, the specific configuration is not limited to the embodiment described above, but design change within the scope or the spirit of the invention is also included therein. For example, the image display device is not limited to the application to the projector 1 for projecting an image, but an application to the device for directly viewing the image displayed on a display surface such as a mobile viewer can also be assumed.

Further, the projector 1 is not limited to the three-panel type using three liquid crystal light valves. The invention can also be applied to, for example, a single-panel projector 1 capable of modulating the R light, the G light, and the B light with a single liquid crystal light valve 40.

Further, although the transmissive liquid crystal light valves 40 are used as the light modulation device, it is also possible to use a reflective light modulation device such as reflective liquid crystal light valves. Further, it is also possible to use a micromirror array device or the like for modulating the light emitted from the light source by controlling the emission direction of the incident light micromirror by micromirror.

Further, although the light source 11 is configured including the discharge light source lamp, there can also be used a sold-state light source such as a light emitting diode (LED) or a laser diode, and other light sources.

Further, the device for achieving the system described above can be realized by a single device in some cases, or can also be realized by combining a plurality of devices, and therefore, a variety of configurations are included.

Each of the constituents and the combinations of the constituents in the embodiment are illustrative only, and modifications such as addition, omission, or substitution of a constituent can be provided within the scope or the spirit of the invention. Further, the invention is not limited to the embodiment, but is only limited by the appended claims.

What is claimed is:

1. An image display device adapted to display an image based on an image signal, comprising:

a light source;

an adjustment section adapted to adjust light intensity of a light emitted from the light source based on a feature amount related to a luminance of the image;

a modulation section adapted to modulate the adjusted light based on the image signal; and a control section adapted to suppress reduction of the light intensity by the adjustment section in a case in which a predetermined condition related to temperature of the modulation section is satisfied.

2. The image display device according to claim 1, wherein the control section stops the reduction of the light intensity by the adjustment section in a case in which the predetermined condition is satisfied.

3. The image display device according to claim 1, wherein the adjustment section adjusts the light intensity based on the feature amount and the control by the control section.

4. The image display device according to claim 3, wherein the adjustment section determines a reduction coefficient used to reduce the light intensity based on the feature amount, determines a suppression coefficient used to suppress the reduction corresponding to the reduction coefficient based on the control by the control section, and reduces the light intensity based on the reduction coefficient and the suppression coefficient.

5. The image display device according to claim 4, wherein the control section is further adapted to end suppression of the reduction of the light intensity in a case in which the predetermined condition becomes unsatisfied, and the adjustment section reduces the light intensity based on the reduction coefficient.

6. The image display device according to claim 1, further comprising:

an expansion section adapted to expand a grayscale range of the luminance of an image represented by the image signal based on the feature amount, wherein the expansion section expands the grayscale range so that the luminance of a modulated image obtained by modulating the image signal in the modulation section becomes roughly constant irrespective of whether or not the predetermined condition is satisfied.

7. The image display device according to claim 1, further comprising:

a temperature information acquisition section adapted to obtain information related to the temperature of the modulation section, wherein the control section suppresses the reduction of the light intensity by the adjustment section in a case in which the temperature is one of equal to and lower than a predetermined temperature.

8. The image display device according to claim 1, wherein the control section suppresses the reduction of the light intensity by the adjustment section in a case in which a predetermined reference time does not elapse from when the light source is put on.

9. The image display device according to claim 1, further comprising:

an image processing section adapted to generate the feature amount and the image signal based on image data input.

10. A method of controlling an image display device adapted to display an image based on an image signal, the method comprising:

adjusting light intensity of a light emitted from a light source based on a feature amount related to a luminance of the image;

modulating, by a modulation section, the adjusted light based on the image signal; and suppressing reduction of the light intensity in the adjusting in a case in which a predetermined condition related to temperature of the modulation section is satisfied.

11. The method of controlling the image display device according to claim 10, wherein the reduction of the light intensity in the adjusting is stopped in the suppressing in a case in which the predetermined condition is satisfied.

12. The method of controlling the image display device according to claim 10, wherein the light intensity is adjusted in the adjusting based on the feature amount and the control in the suppressing.

13. The method of controlling the image display device according to claim 12, wherein in the adjusting, a reduction coefficient used to reduce the light intensity is determined based on the feature amount, a suppression coefficient used to suppress the reduction corresponding to the reduction coefficient is determined based on the control in the suppressing, and the light intensity is reduced based on the reduction coefficient and the suppression coefficient.

14. The method of controlling the image display device according to claim 13, wherein in the suppressing, ending suppression of the reduction of the light intensity in a case in which the predetermined condition becomes unsatisfied, and in adjusting, the light intensity is reduced based on the reduction coefficient.

15. The method of controlling the image display device according to claim 10, further comprising:

expanding a grayscale range of the luminance of an image represented by the image signal based on the feature amount, wherein in the expanding, the grayscale range is expanded so that the luminance of a modulated image obtained by modulating the image signal in the modulating becomes roughly constant irrespective of whether or not the predetermined condition is satisfied.

16. The method of controlling the image display device according to claim 10, further comprising:

obtaining information related to the temperature of the modulation section, wherein in the suppressing, the reduction of the light intensity in adjusting is suppressed in a case in which the temperature is one of equal to and lower than a predetermined temperature.

17. The method of controlling the image display device according to claim 10, wherein in the suppressing, the reduction of the light intensity in adjusting is suppressed in a case in which a predetermined reference time does not elapse from when the light source is put on.

18. The method of controlling the image display device according to claim 10, further comprising:

generating the feature amount and the image signal based on image data input.

* * * * *